US005551697A

United States Patent [19]

Willenbring

[11] Patent Number: 5,551,697

[45] Date of Patent: Sep. 3, 1996

[54] SPORT WAGERING AND OUTCOME GAME APPARATUS

[76] Inventor: Vince Willenbring, 556 E. Bellwood Ave., Maplewood, Minn. 55117

[21] Appl. No.: 561,039

[22] Filed: Nov. 20, 1995

[51] Int. Cl.[6] ..... A63F 3/00

[52] U.S. Cl. ..... 273/244

[58] Field of Search ..... 273/242, 243, 273/244, 245, 246, 247, 259

[56] References Cited

U.S. PATENT DOCUMENTS

| | | | |
|---|---|---|---|
| Des. 343,645 | 1/1994 | Stenger . | |
| 2,481,709 | 9/1949 | Adams | 273/244 X |
| 3,997,167 | 12/1976 | Kratzer | 273/244 |
| 4,010,957 | 3/1977 | Tricoli | 273/244 X |
| 4,261,569 | 4/1981 | Frohlich . | |
| 4,583,741 | 4/1986 | Brisciano | 273/244 |
| 4,653,755 | 3/1987 | Panella et al. . | |
| 4,687,199 | 8/1987 | Aguirregomez Corta . | |
| 4,890,843 | 1/1990 | Chauve | 273/244 X |
| 5,280,912 | 1/1994 | Porter . | |
| 5,383,669 | 1/1995 | Vance | 273/244 |
| 5,476,263 | 12/1995 | Romaniello | 273/244 |

*Primary Examiner*—William E. Stoll

[57] ABSTRACT

A sport wagering and outcome game apparatus includes a game board having a plurality of game spaces which are sites for specific games. A group of tokens are provided for movement on the game spaces of the game board. Each player adopts a specific token in the group of tokens. A first group of team cards corresponds to a first group of sport teams. A second group of team cards corresponds to a second group of sport teams. A first random number generator generates numbers which correspond to individual teams of the first group of sport teams for selecting an individual first-group team to play in a specific game. A second random number generator generates numbers which correspond to individual teams of the second group of sport teams for selecting an individual second-group team to play in a specific game. A first group of score-bearing cards bears scores of player-predicted winners for specific games. A second group of score-bearing cards bears scores of player-predicted losers for specific games. Recording media are provided for recording actual outcomes of specific games, that is, for recording actual winners and losers of specific games. Money is used for wagering by individual players with respect to actual outcomes of specific games. A portion of the money is transferred from a player wagering for a win of an actual loser of a specific game to a player wagering for a win of an actual winner of a specific game.

11 Claims, 8 Drawing Sheets

FIG 2
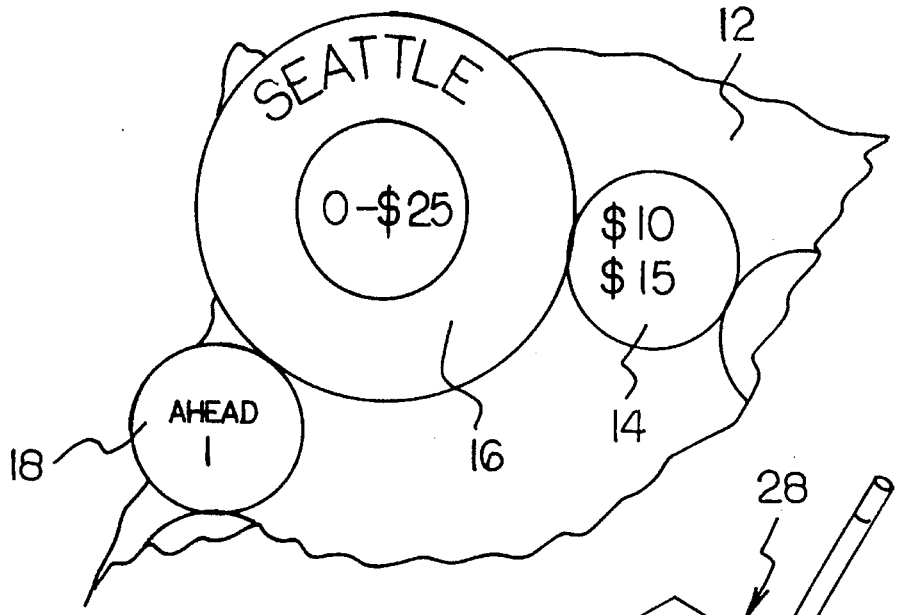
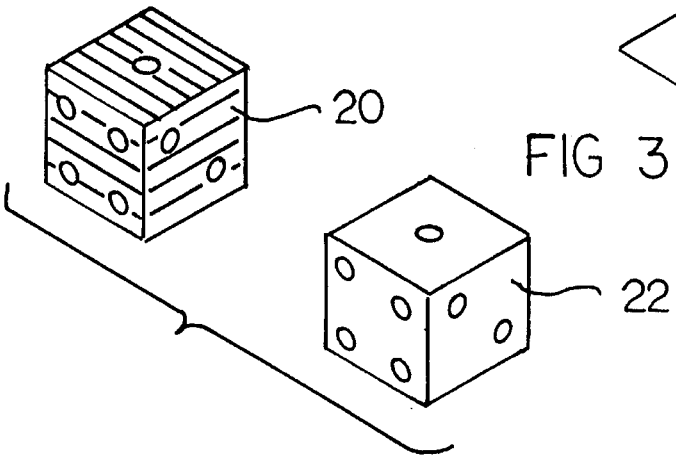
FIG 3
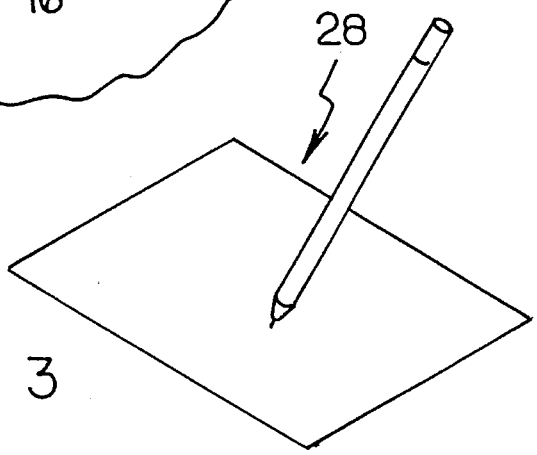
FIG 3A
FIG 4
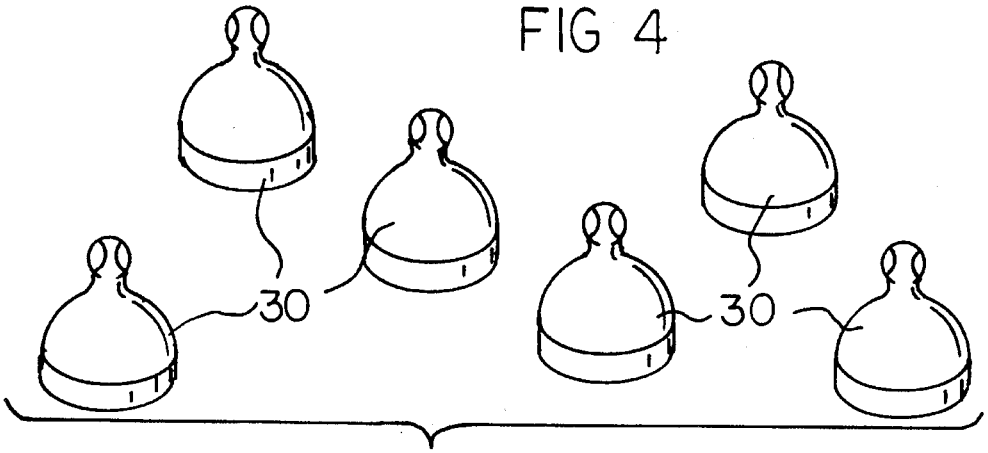

FIG 8

The Game Board
LEGEND

1. Seattle Stadium
2. $10/$15
3. $15/$25
4. $0/$20
5. $15/$20
6. $0/$5
7. $0/$25
8. $5/$10
9. $10/$20
10. $0/$15
11. $5/$25
12. $10/$25
13. Ahead 1
14. Colorado Stadium
15. $15/$25
16. $0/$20
17. $5/$15
18. $0/$5
19. Ahead 1
20. Kansas City Stadium
21. $5/$20
22. $0/$10
23. $20/$25
24. Ahead 1
25. Minnesota Stadium
26. $5/$25
27. $0/$5
28. $10/$20
29. Ahead 1
30. Chicago Stadium
31. $0/$10
32. $0/$15
33. Ahead 1
34. Cincinnati Stadium
35. $10/$15
36. $5/$25
37. $0/$20
38. Ahead 1
39. Toronto Stadium
40. $10/$25
41. $0/$25
42. Ahead 1
43. New York Stadium
44. $15/$20
45. $5/$10
46. $15/$25
47. $5/$15
48. $20/$25
49. $5/$25
50. $0/$20
51. $10/$20
52. $15/$20
53. $0/$5
54. $15/$20
55. Ahead 1
56. Florida Stadium
57. $0/$15
58. $20/$25
59. $5/$10
60. $10/$25
61. Ahead 1
62. Atlanta Stadium
63. $0/$10
64. $15/$25
65. $5/$20
66. $10/$15
67. $0/$25
68. $5/$25
69. Ahead 1
70. Texas
71. $10/$20
72. $5/$15
73. $0/$5
74. $15/$20
75. $0/$10
76. $20/$25
77. $10/$25
78. $0/$15
79. $5/$10
80. $15/$25
81. $0/$25
82. $10/$15
83. $5/$20
84. Ahead 1
85. Los Angeles
86. $0/$20
87. $5/$15
88. $10/$25
89. $0/$15
90. $5/$25
91. $15/$20
92. $0/$10
93. $10/$20
94. $5/$10
95. $20/$25
96. Ahead 1

FIG 9

BOOKIE BASEBALL scoresheet

| West (red) League | Wins | Losses |
|---|---|---|
| 1. Texas | | |
| 2. Los Angeles | | |
| 3. Seattle | | |
| 4. Colorado | | |
| 5. Kansas City | | |
| 6. Minnesota | | |

| East (white) League | Wins | Losses |
|---|---|---|
| 1. Chicago | | |
| 2. Cincinnati | | |
| 3. Toronto | | |
| 4. New York | | |
| 5. Florida | | |
| 6. Atlanta | | |

Championship

| | 1 | 2 | 3 | 4 | 5 | 6 | 7 | |
|---|---|---|---|---|---|---|---|---|
| Favorite | [a] | [u] | [a] | [u] | [a] | [u] | [a] | |
| | | | | | | | | Champion |
| Opponent | [u] | [a] | [u] | [a] | [u] | [a] | [u] | |

FIG 10

CHAMPIONSHIP SERIES EXAMPLE:

| West (red) League | wins | losses | winning % |
|---|---|---|---|
| 1. Texas | 4 | 6 | .400 |
| 2. Los Angeles | 6 | 3 | .667 |
| 3. Seattle | 3 | 5 | .375 |
| 4. Colorado | 2 | 4 | .333 |
| 5. Kansas City | 5 | 5 | .500 |
| 6. Minnesota | 8 | 4 | .667 |

| East (white) League | wins | losses | winning % |
|---|---|---|---|
| 1. Chicago | 5 | 7 | .417 |
| 2. Cincinnati | 10 | 4 | .714 |
| 3. Toronto | 3 | 7 | .300 |
| 4. New York | 4 | 5 | .444 |
| 5. Florida | 6 | 4 | .600 |
| 6. Atlanta | 2 | 4 | .333 |

Championship

```
                          1  2  3  4  5  6  7
_____Cincinnati_________[a][u][a][u][a][u][a]
      Favorite                                 |
                                               |
                                               |_________________
                                               |     Champion
                          1  2  3  4  5  6  7 |
_____Minnesota__________[u][a][u][a][u][a][u]
      Opponent
```

[Minnesota advances to the championship series over Los Angeles for having more wins (8 compared with 6).]

| championship games: | | 1 | 2 | 3 | 4 | 5 | 6 | 7 (unnecessary) |
|---|---|---|---|---|---|---|---|---|
| draw results: | a | 7 | 5 | 6* | 3 | 6 | 1 | - (* Cincinnati |
| | u | 3 | 4 | 6 | 0 | 2 | 5 | - won dice roll.) |

```
                          1  2  3  4  5  6  7
_____Cincinnati_________[X][u][X][u][X][X][a]
      Favorite                                 |
                                               |
                                               |__Cincinnati____
                                               |    Champion
                          1  2  3  4  5  6  7 |
_____Minnesota__________[u][X][u][X][u][a][u]
      Opponent
```

Cincinnati wins the series four games to two, and the owner of Cincinnati wins this game of Bookie Baseball.

FIG 11

THE GAME DECKS

UNDERDOG

| | | 0 | 0 | 0 | 1 | 1 | 2 | 2 | 2 | 3 | 3 | 3 | 4 | 4 | 4 | 4 | 5 | 5 | 5 | 5 | 6 | 6 | 6 | 6 | 7 | 7 | 8 | 9 |
|---|---|---|---|---|---|---|---|---|---|---|---|---|---|---|---|---|---|---|---|---|---|---|---|---|---|---|---|---|
| | 0 | T | T | T | U | U | U | U | U | U | U | U | U | U | U | U | U | U | U | U | U | U | U | U | U | U | U | U |
| | 1 | A | A | A | T | T | U | U | U | U | U | U | U | U | U | U | U | U | U | U | U | U | U | U | U | U | U | U |
| | 2 | A | A | A | A | A | T | T | T | U | U | U | U | U | U | U | U | U | U | U | U | U | U | U | U | U | U | U |
| | 2 | A | A | A | A | A | T | T | T | U | U | U | U | U | U | U | U | U | U | U | U | U | U | U | U | U | U | U |
| | 3 | A | A | A | A | A | A | A | A | T | T | T | U | U | U | U | U | U | U | U | U | U | U | U | U | U | U | U |
| | 4 | A | A | A | A | A | A | A | A | A | A | A | T | T | T | T | U | U | U | U | U | U | U | U | U | U | U | U |
| | 4 | A | A | A | A | A | A | A | A | A | A | A | T | T | T | T | U | U | U | U | U | U | U | U | U | U | U | U |
| | 4 | A | A | A | A | A | A | A | A | A | A | A | T | T | T | T | U | U | U | U | U | U | U | U | U | U | U | U |
| | 4 | A | A | A | A | A | A | A | A | A | A | A | T | T | T | T | U | U | U | U | U | U | U | U | U | U | U | U |
| A | 5 | A | A | A | A | A | A | A | A | A | A | A | A | A | A | A | T | T | T | T | U | U | U | U | U | U | U | U |
| D | 5 | A | A | A | A | A | A | A | A | A | A | A | A | A | A | A | T | T | T | T | U | U | U | U | U | U | U | U |
| V | 5 | A | A | A | A | A | A | A | A | A | A | A | A | A | A | A | T | T | T | T | U | U | U | U | U | U | U | U |
| A | 5 | A | A | A | A | A | A | A | A | A | A | A | A | A | A | A | T | T | T | T | U | U | U | U | U | U | U | U |
| N | 6 | A | A | A | A | A | A | A | A | A | A | A | A | A | A | A | A | A | A | A | T | T | T | T | U | U | U | U |
| T | 6 | A | A | A | A | A | A | A | A | A | A | A | A | A | A | A | A | A | A | A | T | T | T | T | U | U | U | U |
| A | 6 | A | A | A | A | A | A | A | A | A | A | A | A | A | A | A | A | A | A | A | T | T | T | T | U | U | U | U |
| G | 6 | A | A | A | A | A | A | A | A | A | A | A | A | A | A | A | A | A | A | A | T | T | T | T | U | U | U | U |
| E | 7 | A | A | A | A | A | A | A | A | A | A | A | A | A | A | A | A | A | A | A | A | A | A | A | T | T | U | U |
| | 7 | A | A | A | A | A | A | A | A | A | A | A | A | A | A | A | A | A | A | A | A | A | A | A | T | T | U | U |
| | 7 | A | A | A | A | A | A | A | A | A | A | A | A | A | A | A | A | A | A | A | A | A | A | A | T | T | U | U |
| | 7 | A | A | A | A | A | A | A | A | A | A | A | A | A | A | A | A | A | A | A | A | A | A | A | T | T | U | U |
| | 8 | A | A | A | A | A | A | A | A | A | A | A | A | A | A | A | A | A | A | A | A | A | A | A | A | A | T | U |
| | 8 | A | A | A | A | A | A | A | A | A | A | A | A | A | A | A | A | A | A | A | A | A | A | A | A | A | T | U |
| | 9 | A | A | A | A | A | A | A | A | A | A | A | A | A | A | A | A | A | A | A | A | A | A | A | A | A | A | T |
| | 9 | A | A | A | A | A | A | A | A | A | A | A | A | A | A | A | A | A | A | A | A | A | A | A | A | A | A | T |
| | 10 | A | A | A | A | A | A | A | A | A | A | A | A | A | A | A | A | A | A | A | A | A | A | A | A | A | A | A |
| | 10 | A | A | A | A | A | A | A | A | A | A | A | A | A | A | A | A | A | A | A | A | A | A | A | A | A | A | A |

FIG 12

Winning percentages and team worth

The following chart details the winning percentages and worths for teams with records ranging from 0 wins and 0 losses to 10 wins and 10 losses. For records outside this range, the formulas used to calculate this information are provided to allow players to figure out this information as needed. The following information is contained within each box:

record
winning %
team worth

Formulas:

$$\text{winning \%} = \frac{\text{wins}}{\text{wins + losses}}$$

worth= $100 + 10(wins minus losses)

LOSSES

| WINS | 0 | 1 | 2 | 3 | 4 | 5 | 6 | 7 | 8 | 9 | 10 |
|---|---|---|---|---|---|---|---|---|---|---|---|
| 0 | 0-0<br>.000<br>$100 | 0-1<br>.000<br>$90 | 0-2<br>.000<br>$80 | 0-3<br>.000<br>$70 | 0-4<br>.000<br>$60 | 0-5<br>.000<br>$50 | 0-6<br>.000<br>$40 | 0-7<br>.000<br>$30 | 0-8<br>.000<br>$20 | 0-9<br>.000<br>$10 | 0-10<br>.000<br>$0 |
| 1 | 1-0<br>1.00<br>$110 | 1-1<br>.500<br>$100 | 1-2<br>.333<br>$90 | 1-3<br>.250<br>$80 | 1-4<br>.200<br>$70 | 1-5<br>.166<br>$60 | 1-6<br>.143<br>$50 | 1-7<br>.125<br>$40 | 1-8<br>.111<br>$30 | 1-9<br>.100<br>$20 | 1-10<br>.091<br>$10 |
| 2 | 2-0<br>1.00<br>$120 | 2-1<br>.667<br>$110 | 2-2<br>.500<br>$100 | 2-3<br>.400<br>$90 | 2-4<br>.333<br>$80 | 2-5<br>.286<br>$70 | 2-6<br>.250<br>$60 | 2-7<br>.222<br>$50 | 2-8<br>.200<br>$40 | 2-9<br>.182<br>$30 | 2-10<br>.166<br>$20 |
| 3 | 3-0<br>1.00<br>$130 | 3-1<br>.750<br>$120 | 3-2<br>.600<br>$110 | 3-3<br>.500<br>$100 | 3-4<br>.429<br>$90 | 3-5<br>.375<br>$80 | 3-6<br>.333<br>$70 | 3-7<br>.300<br>$60 | 3-8<br>.273<br>$50 | 3-9<br>.250<br>$40 | 3-10<br>.231<br>$30 |
| 4 | 4-0<br>1.00<br>$140 | 4-1<br>.800<br>$130 | 4-2<br>.667<br>$120 | 4-3<br>.571<br>$110 | 4-4<br>.500<br>$100 | 4-5<br>.444<br>$90 | 4-6<br>.400<br>$80 | 4-7<br>.364<br>$70 | 4-8<br>.333<br>$60 | 4-9<br>.308<br>$50 | 4-10<br>.286<br>$40 |
| 5 | 5-0<br>1.00<br>$150 | 5-1<br>.833<br>$140 | 5-2<br>.714<br>$130 | 5-3<br>.625<br>$120 | 5-4<br>.556<br>$110 | 5-5<br>.500<br>$100 | 5-6<br>.455<br>$90 | 5-7<br>.417<br>$80 | 5-8<br>.385<br>$70 | 5-9<br>.357<br>$60 | 5-10<br>.333<br>$50 |
| 6 | 6-0<br>1.00<br>$160 | 6-1<br>.857<br>$150 | 6-2<br>.750<br>$140 | 6-3<br>.667<br>$130 | 6-4<br>.600<br>$120 | 6-5<br>.545<br>$110 | 6-6<br>.500<br>$100 | 6-7<br>.462<br>$90 | 6-8<br>.429<br>$80 | 6-9<br>.400<br>$70 | 6-10<br>.375<br>$60 |
| 7 | 7-0<br>1.00<br>$170 | 7-1<br>.875<br>$160 | 7-2<br>.778<br>$150 | 7-3<br>.700<br>$140 | 7-4<br>.636<br>$130 | 7-5<br>.583<br>$120 | 7-6<br>.539<br>$110 | 7-7<br>.500<br>$100 | 7-8<br>.467<br>$90 | 7-9<br>.438<br>$80 | 7-10<br>.412<br>$70 |
| 8 | 8-0<br>1.00<br>$180 | 8-1<br>.889<br>$170 | 8-2<br>.800<br>$160 | 8-3<br>.727<br>$150 | 8-4<br>.667<br>$140 | 8-5<br>.615<br>$130 | 8-6<br>.571<br>$120 | 8-7<br>.533<br>$110 | 8-8<br>.500<br>$100 | 8-9<br>.471<br>$90 | 8-10<br>.444<br>$80 |
| 9 | 9-0<br>1.00<br>$190 | 9-1<br>.900<br>$180 | 9-2<br>.818<br>$170 | 9-3<br>.750<br>$160 | 9-4<br>.692<br>$150 | 9-5<br>.643<br>$140 | 9-6<br>.600<br>$130 | 9-7<br>.563<br>$120 | 9-8<br>.529<br>$110 | 9-9<br>.500<br>$100 | 9-10<br>.474<br>$90 |
| 10 | 10-0<br>$200<br>1.00 | 10-1<br>$190<br>.909 | 10-2<br>$180<br>.833 | 10-3<br>$170<br>.769 | 10-4<br>$160<br>.714 | 10-5<br>$150<br>.666 | 10-6<br>$140<br>.625 | 10-7<br>$130<br>.588 | 10-8<br>$120<br>.556 | 10-9<br>$110<br>.526 | 10-10<br>$100<br>.500 |

SPORT WAGERING AND OUTCOME GAME APPARATUS

BACKGROUND OF THE INVENTION

1. Field of the Invention

The present invention relates generally to games which employ a game board and, more particularly, to board games especially adapted for playing simulated sport games.

2. Description of the Prior Art

There are a large number of board games, and a wide range of themes are encompassed by board games. Of special interest are board games which relate to specific sports. Of even more particular interest are board games which relate to the sport of baseball. Throughout the years, a number of innovations have been developed relating to board games involving the sport of baseball, and the following U.S. Patents are representative of some of those innovations: 4,261,569, 4,653,755, 4,687,199, 5,280,912, and Des. 343,645. Although the above-cited patented board games differ in many respects from one another, they all share a common characteristic. All of the above-cited board games relate to the simulated playing of an individual game of baseball.

In a baseball season, the winning-most team in each league will play in a World Series. To determine which are the winning-most teams, records are kept of wins and losses for each game for each team throughout the season. Although this is the way real-life baseball is conducted, there is no board game which simulates the a baseball season. That is, there is no board game which provides for a season's amount of specific games. Moreover, there is no board game that provides for recording the win-loss record of each team so that an overall season champion can be determined in the game. In this respect, it would be desirable if a board game were provided which simulates the plurality of specific games that take place in a baseball season. Moreover, it would be desirable if a board game were provided which records the win-loss records of individual teams during a season.

Still other features would be desirable in a board game that simulates the plurality of specific games that take place in a baseball season. For example, during a baseball season, many individuals bet or wager on the outcomes of specific games. The more successful the wagerer is, the more money the wagerer accumulates. In this respect, it would be desirable if a board game were provided includes wagering for specific games. In addition, it would be desirable for the board game to provide a form of money which is the currency in which the wagering takes place.

In a real baseball season, the schedule of games and the arrangement of opponents for specific games is not predictable by a fan or person who follows the games throughout the season. In this respect, it would be desirable if a board game were provided in which the schedule of specific games and the matching of opponents in specific games were unpredictably and randomly selected.

Thus, while the foregoing body of prior art indicates it to be well known to use board games that simulate a specific game of baseball, the prior art described above does not teach or suggest a sport wagering and outcome game apparatus which has the following combination of desirable features: (1) simulates the plurality of specific games that take place in a sport season; (2) provides for the recording of win-loss records of individual teams during a season; (3) includes wagering for specific games; (4) provides a form of money which is the currency in which the wagering takes place; and (5) provides a schedule of specific games and the matching of opponents in specific games by unpredictable and random selection. The foregoing desired characteristics are provided by the unique sport wagering and outcome game apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a sport wagering and outcome game apparatus which includes a game board which includes a plurality of game spaces, wherein each game space represents a specific game. A group of tokens are provided for movement on the game spaces of the game board. Each player adopts a specific token in the group of tokens. A first group of team cards corresponds to a first group of sport teams. A second group of team cards corresponds to a second group of sport teams. A first random number generator generates numbers which correspond to individual teams of the first group of sport teams for selecting an individual first-group team to play in a specific game. A second random number generator generates numbers which correspond to individual teams of the second group of sport teams for selecting an individual second-group team to play in a specific game. A first group of score-bearing cards bears scores of player-predicted winners for specific games. A second group of score-bearing cards bears scores of player-predicted losers for specific games. Recording media are provided for recording actual outcomes of specific games, that is, for recording winners and losers of specific games. Money is used for wagering by individual players with respect to actual outcomes of specific games. A portion of the money is transferred from a player wagering for a win of an actual loser of a specific game to a player wagering for a win of an actual winner of a specific game.

The game spaces are arranged on the game board in a circuitous route. The game board further includes home team spaces. The home team spaces are designated "stadium" spaces. The game board further includes move-ahead spaces. The first group of sport teams corresponds to a first league. The second group of sport teams corresponds to a second league. The first group of team cards and the second group of team cards are merged and combined into a combined group of team cards. The first group of score-bearing cards are designated "advantage" cards. The second group of score-bearing cards are designated "underdog" cards. The first group of sport teams corresponds to a first league of baseball teams. The second group of sport teams corresponds to a second league of baseball teams, and the specific games correspond to specific baseball games.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sport wagering and outcome game apparatus which has all of the advantages of the prior art and none of the disadvantages.

It is another object of the present invention to provide a new and improved sport wagering and outcome game apparatus which may be easily and efficiently manufactured and marketed.

It is a further object of the present invention to provide a new and improved sport wagering and outcome game apparatus which is of durable and reliable construction.

An even further object of the present invention is to provide a new and improved sport wagering and outcome game apparatus which is susceptible of a low cost of manufacture with regard to both materials and labor, and which accordingly is then susceptible of low prices of sale to the consuming public, thereby making such sport wagering and outcome game apparatus available to the buying public.

Still yet a further object of the present invention is to provide a new and improved sport wagering and outcome game apparatus which simulates the plurality of specific games that take place in a sport season.

Still another object of the present invention is to provide a new and improved sport wagering and outcome game apparatus that provides for the recording of win-loss records of individual teams during a season.

Yet another object of the present invention is to provide a new and improved sport wagering and outcome game apparatus which includes wagering for specific games.

Even another object of the present invention is to provide a new and improved sport wagering and outcome game apparatus that provides a form of money which is the currency in which the wagering takes place.

Still a further object of the present invention is to provide a new and improved sport wagering and outcome game apparatus which provides a schedule of specific games and the matching of opponents in specific games by unpredictable and random selection.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 2 is an enlarged view of the portion of the game board that is contained in circled region 2 of FIG. 1.

FIG. 3 is a perspective view of a first random number generator in the form of a first die and a second random number generator in the form of a second die.

FIG. 3A is a schematic depiction of the recording media which may be used in carrying out the present invention.

FIG. 4 is a perspective view of a group of tokens used by players who play the game.

FIG. 8 is a legend explaining the contents of game spaces 1–96 on the game board.

FIG. 9 is an example of recording media in the form of a score sheet.

FIG. 10 is a table showing an example of a championship series.

FIG. 11 is a table showing differences between "advantage" and "underdog" cards with respect to winning and losing game sc.

FIG. 12 is a table showing winning percentages and team worth for an exemplary season.

DESCRIPTION OF THE PREFERRED EMBODIMENT

With reference to the drawings, a new and improved sport wagering and outcome game apparatus embodying the principles and concepts of the present invention will be described.

Figure 1:
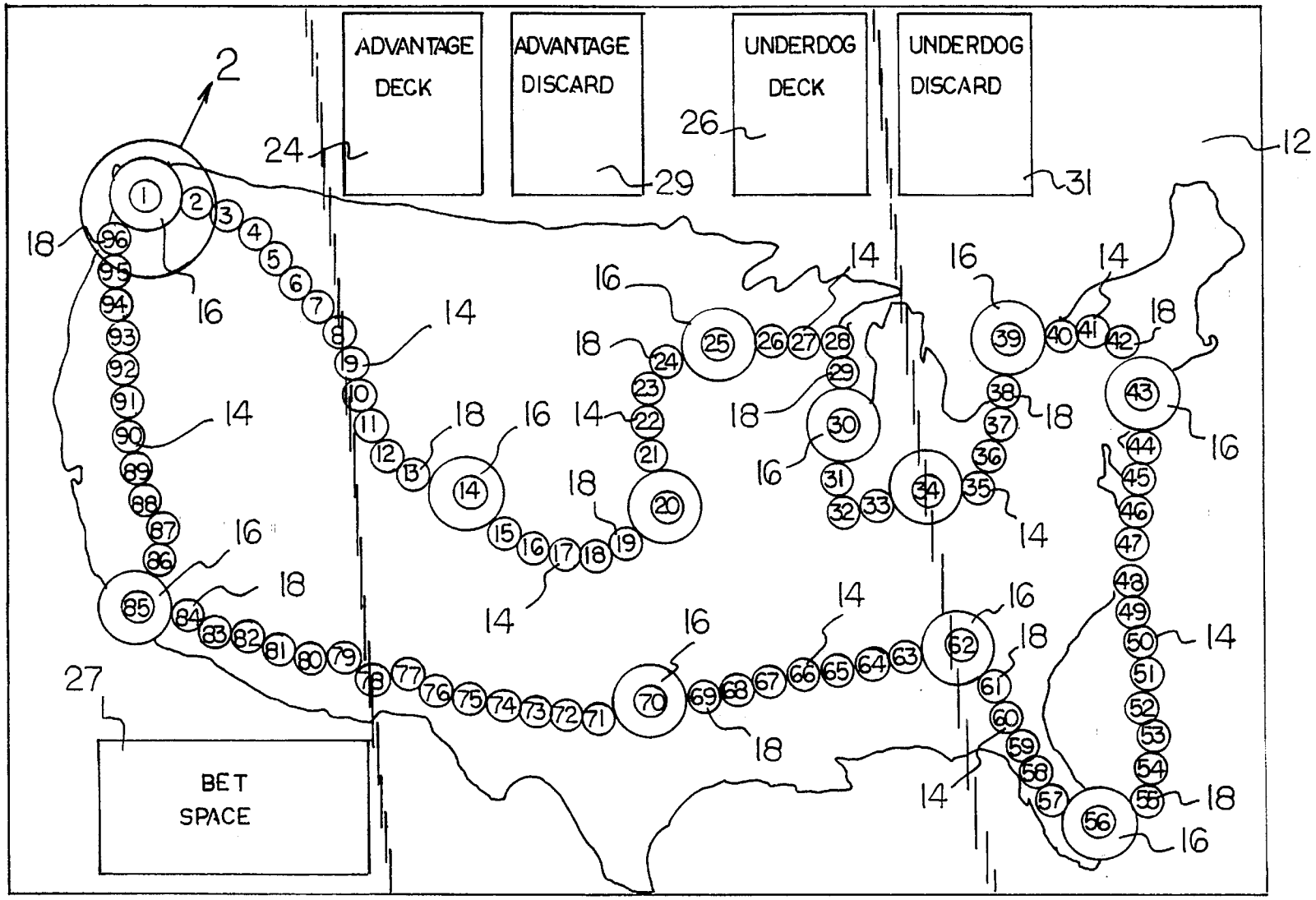
FIG. 1 is a top view showing a preferred embodiment of the game board of the sport wagering and outcome game apparatus of the invention.
Figure 5:
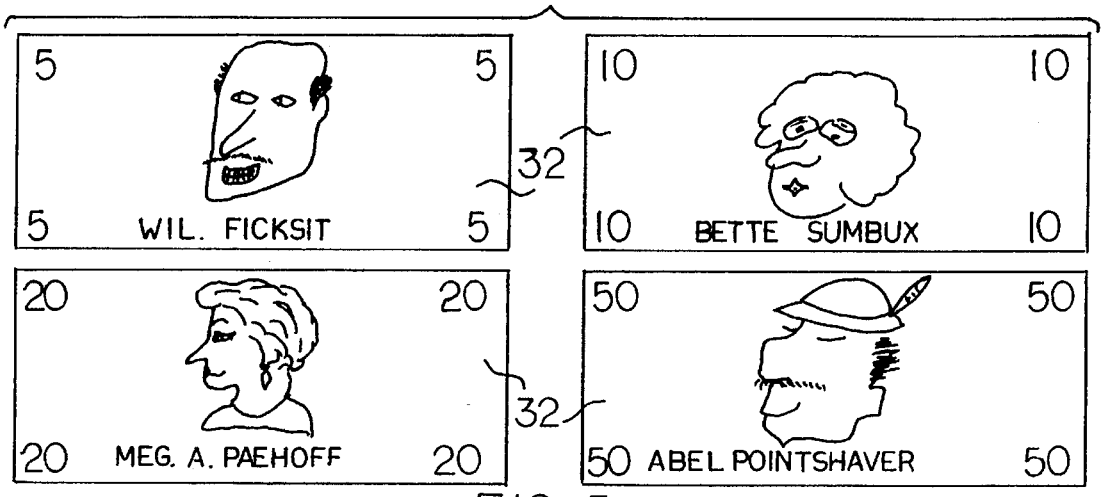
FIG. 5 is a top view of a pool of money showing a plurality of different denominations of money used in the game for wagering.
Figure 6:
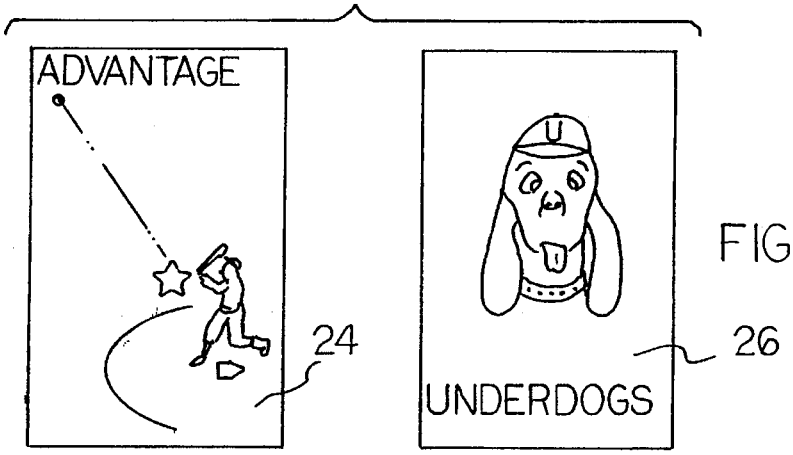
FIG. 6 is a top view of a first group of score-bearing cards designated "advantaged" cards and a second group of score-bearing cards designated "underdog" cards.
Figure 7:
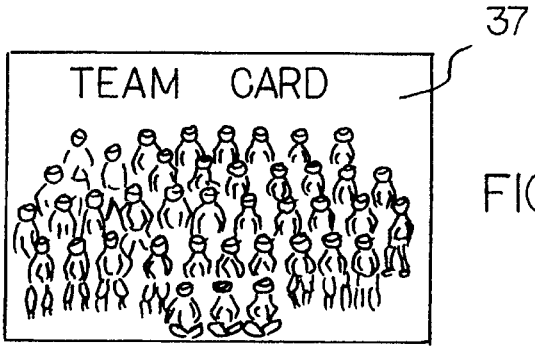
FIG. 7 is a top view of a merged and combined group of team cards which include a first group of team cards for teams in a first league and a second group of team cards for teams in a second league.

Turning to FIGS. 1–12, there are shown various components of the sport wagering and outcome game apparatus of the invention and additional features of playing games employing the apparatus. The sport wagering and outcome game apparatus includes a game board 12 which includes a plurality of game spaces 14, wherein each game space 14 represents a specific game. A group of tokens 30 are provided for movement on the game spaces 14 of the game board 12. Each player adopts a specific token in the group of tokens 30. A first group of team cards corresponds to a first group of sport teams. A second group of team cards corresponds to a second group of sport teams. A first random number generator 20 generates numbers which correspond to individual teams of the first group of sport teams for selecting an individual first-group team to play in a specific game. A second random number generator 22 generates numbers which correspond to individual teams of the second group of sport teams for selecting an individual second-group team to play in a specific game. A first group of score-bearing card 24 bears scores of player-predicted winners for specific games. A second group of score-bearing cards 26 bears scores of player-predicted losers for specific games. Recording media 28 are provide for recording actual outcomes of specific games, that is, for recording winners and losers of specific games. Money 32 is used for wagering by individual players with respect to actual outcomes of specific games. A portion of the money 32 is transferred from a player wagering for a win of an actual loser of a specific game to a player wagering for a win of an actual winner of a specific game.

The game spaces 14 are arranged on the game board 12 in a circuitous route. The game board 12 further includes home team spaces 16. The home team spaces 16 are designated "stadium" spaces. The game board 12 further includes move-ahead spaces 18. The first group of sport teams corresponds to a first league. The second group of sport teams corresponds to a second league. The first group of team cards and the second group of team cards are merged and combined into a combined group of team cards 37. The first group of score-bearing cards 24 are designated "advantage" cards. The second group of score-bearing cards 26 are designated "underdog" cards. The first group of sport teams corresponds to a first league of baseball teams. The second group of sport teams corresponds to a second league of baseball teams, and the specific games correspond to specific baseball games.

The object of playing the sport wagering and outcome game apparatus is to win a sports championship. The sport wagering and outcome game apparatus can be used to play a wide variety of sports such as basketball, football, soccer, and baseball, among others. The remaining description of the sport wagering and outcome game apparatus and the game played using the apparatus is directed to the sport of baseball. To begin the game. Each player receives a sheet such as shown in FIG. 9. Also. A predetermined amount of money is distributed to each player. The money is obtained from the pool of money shown in FIG. 5. The amount of money distributed to each player is determined by the number of players who are playing the game. More specifically, if there are 6 players, each player receives $200, if there are 5 players, each player receives $240, if there are 4 players, each player receives $300, if there are 3 players, each player receives $400, if there are 2 players, each player receives $600.

The players take turns rolling the two dice, the first random number generator 20 and the second random number generator 22. The player rolling the highest number buys any one of the twelve teams first followed by the other players in clockwise order. Teams are purchased for $100. Players must buy at least one team to start the game and can buy other teams from the pool anytime during the game. A player picks a team, pays the $100 to the pool and receives the card with the team's name on it from the team card deck. The buying of teams continues in a clockwise direction around the game board 12 until each player has bought at least one team. Unpurchased teams become property of the pool. The players then place their playing tokens on the home team spaces 16 inscribed with the name of a team they own. The legend in FIG. 8 can be consulted to determine the names for the home team spaces 16. Players shuffle the deck of "advantage" cards 24 and the deck of "underdog" cards 26. The decks of "advantage" cards 24 and "underdog" cards 26 are placed face down on their appropriate spaces on the game board 12. The player who had first pick of a team rolls the two dice and moves that number of spaces in a clockwise direction around the game board 12. He or she can land on a game space 14, home team space 16, or a move-ahead space 18.

Each game space 14 has two different dollar amounts on it. When a player lands on a game space 14, the player decides which two teams will play in a specific game. The player has any one or his or her teams play another team determined by the dice. The two numbers on the two dice represent the two teams from which the player can choose to play. The red die represents teams from the Red League, and the white die represents teams from the White League. The numbers on the dice correspond to the numbers in front of the teams in each league on the score sheet shown in FIG. 9. After deciding which two teams will play in a game, the player decides which of the teams will receive the advantage. The advantaged team owner decides what amount of wager or bet he or she would like to wager on the specific game. The amounts to choose from are listed on the game space 14. These two amounts can range anywhere from $0 to $25. The owner of the advantaged team places one of the two amounts on the bet space 27. The bet space 27 is left empty if the player wagers $0. Then, the owner of the advantaged team draws the top card from the deck of "advantage" cards 24, and the owner of the underdog team draws the top card from the deck of "underdog" cards 26. The team owner drawing the higher number wins the specific game. If both teams draw the same number. Each of the two players rolls a die, and the player rolling the higher number wins the game. The losing team owner matches the amount of money already on the bet space 27, and the winning owner collects all his money. On all of the players' score sheets, the winning team is given a tally to its win column, and the losing team receives a tally in its loss column. The turn then goes on to the next player in a clockwise direction around the game board 12.

If an advantaged team owner can not afford to wager either amount listed on the game space 14, the underdog team owner receives the advantage, and the advantaged team becomes the underdog. The new advantaged team owner then bets one of the amounts listed on the game space 14. See Example 3 below. If neither team owner can afford to wager either amount listed on the game space 14, the specific game is canceled, and the turn moves on to the next player. See Example 4 below.

If the same player owns both the teams playing in a specific game, the only amount that can be wagered on the game is $0, no matter the amounts listed on the game space 14. See Example 5 below. If the token for a player lands on a home team space 16, the home team space 16 is played differently from a game space 14. If a player's token lands on a home team space 16, the team name printed on the stadium for the home team is automatically given the advantage in the specific game. The player who landed on the home team space 16 then determines an opponent for the home team from either the red die or the white die, corresponding to teams in the red and white leagues, respectively. The owner of the advantaged (home field) team determines an amount to wager on the specific game. The player decides on an amount anywhere from $0 to $25. The owner puts this amount on the bet space 27. He or she then draws the top card from the deck of the "advantage" cards 24, and the underdog team owner draws the top card from the deck of the "underdog" cards 26. The team owner that draws the card with the higher number is the winner. See Examples 6 and 7 below. If the teams tie, the two team owners each roll a die to determine the winner. The loser of the specific game matches the amount on the bet space 27, and the winner collects all the money from the bet space 27. On their score sheets, the players place a tally in the "win" column of the winning team and place a tally in the "loss" column of the losing team. It's then the next player's turn.

If the token for a player lands on a move-ahead space 18, he or she moves ahead one space to a home team space 16. The player then looks to the rolled dice to find an opponent for the home (advantaged) team in a specific game. See Example 8 below.

A player can only sell a team after he or she goes into debt when unable to match the amount on the bet space 27 after losing a specific game. See Example 9 below. This is the only situation in which a player is allowed to sell a team. The amount a player receives for selling a team to the pool depends on the team's record. A team with as many wins as losses sells for $100. A team with one more win than loss sells for $110, with two more wins than losses, $120, and so on. A team with one less win than losses sells for $90, with two less wins than losses, $80, and so on. This is stated by the following formula: $100+(wins-losses)(10)=$ value of team.

When a player sells a team, he or she figures out what his or her team is worth, receives this amount from the pool and gives to the pool the team card of the team just sold. Any team owned by the pool can be bought by a player before her or she rolls the dice for his or her turn. The player looks at the teams owned by the pool and bids any amount on one of the teams. See Example 10 below. The other players can ten bid on the team in a clockwise direction around the game board 12. Their bids must be at least $5 higher than the initial bid and every subsequent bid. The bidding continues until one player has bid an amount no one is willing to bid $5 more than. The player pays the amount of the bid to the pool and receives that team's card. The player who initially bid for the team then continues on with his or her turn by rolling the dices and landing on a game space 14 or a home team space 16. A player can bid on no more than one team each turn. If a player bids an amount on a team but is unable to pay this amount to the pool due to a lack of money, he or she is penalized by losing ownership of a team. The player decides which of his or her teams will be turned over to the pool. The pool receives this team card, and the player who initially bid on the team rolls the dice for his or her turn. The team that was bid on remains in possession of the pool. It is recalled that a player can only sell a team when he or she goes into debt after losing a game.

Players can play games against pool-owned teams. The pool receives money from the bet space 27 when any of its teams win a game, and it pays money to the bet space 27 when its teams lose specific games. The pool is like another player in the game except it doesn't have a token to move. The owner of the opposing team takes (or gives as the case may be) money from (or to) the owner of the pool depending on the outcome of the specific game. The opposing owner also rolls the dice for both the pool and his or her own team in the case of a tie in the specific game. The owner must make clear to the other players which die represents which team for the tie-breaking roll. See Example 11 below. When a pool-owned tea has the advantage, the pool always bets the highest amount listed on the game space 14 or home team space 16 that instigated the specific game. The opposing team owner takes this amount from the pool and places it on the bet space 27 for the specific game. See Example 12 below.

When any team wins ten games, it marks the end of the regular season and the beginning of the championship series. The team with the highest winning fraction in each league advances i to the championship series. To figure out a team's winning fraction, take the number of specific games won by a team and divide this number by the total number of specific games played by that team. This is stated in the following formula Total wins/(total wins+total losses)=winning fraction If two teams have the same winning fraction, the team with more wins advances. If two or more teams in one league are tied with the exact same records, their owners total their own assets (worth of teams+money), and the owner has the greatest assets advances his or her team to the championship series.

The team with the higher winning fraction had the advantage in the series. If the two teams have the same record, the team owners compare their asset value. The owner has greater assets receives the advantage in the championship series. The advantage team in written on the "favorite" line in the brackets at the bottom of the score sheet, and the other team is written on the "opponent" line of the brackets. The deck of "advantage" cards 24 and the deck of "underdog" cards 26 are shuffled and placed on their respective areas on the game board 12. The names on the bracket lines are followed by seven boxes with either an "a" or "u" in each. The seven boxes represent the possible seven games in the series, and the letters "a" and "u" stand for which of the two decks of "advantage" cards 24 or "underdog" cards 26, will be drawn from by each team during each of the specific games in the series. The favorite team owner draws from the deck of "advantage" cards 24 in the first, third, fifth (if necessary), and seventh (if necessary) games of the series and draws from the deck of the "underdog" cards 26 in the second, fourth, and sixth (if necessary) games. The opponent draws from the deck of the "underdog" cards 26 in the first, third, fifth (if necessary), and seventh (if necessary) games of the series draws from the deck of the "advantage" cards 24 in the second, fourth, and sixth (if necessary) games of the series. The winning team of each game receives an "X" in its box under the corresponding game of the series next to its name on the series in crowned champion, and its owner wins the game. See FIG. 10.

EXAMPLES

The following information relates to the numbered Examples set forth below. Player Bill has the teams of Minnesota and New York and has $100. Player Sue has the teams of Florida and Atlanta and has $100. Player Tim has the teams of Toronto, Seattle, and Colorado, and has $0. Player Joan has the teams of Cincinnati, Los Angeles, and Kansas City, and has $0. The Pool has the teams of Chicago and Texas and has $1,500. At the beginning of the game, the four players Bill, Sue, Tim, and Joan each received $300. In turn, the players have purchased their respective teams for $100 apiece and have received the team cards for each team. To start the game, the players place a token on the home team space 16 of the team they own. In this example, Bill places his playing token on the Minnesota home team space 16. Sue puts her token on the Florida home team space 16. Tim puts his token on the Colorado home team space 16. Joan puts her token on the Los Angeles home team space 16.

Example 1

Bill rolls the dice first. He rolls an eleven (red die six, white die five) and moves onto a $5/$25 game space 14. Bill can now choose one of the following two possible game scenarios Minnesota or New York (both owned by Bill) vs. Florida (white five). Bill chooses the following specific game scenario Minnesota vs. Florida (white five). More specifically, Bill chooses to play his Minnesota team against Sue's Florida team. Bill gives Minnesota the advantage, and as the advantaged team owner, Bill can bet either $5 or $25 on the specific game. Bill decides to bet $25 and places this amount on the bet space 27. Bill overturns the top card of the deck of the "advantage" cards 24, which is a seven, and Sue overturns a three as the top card in the deck of the "underdog" cards 26. Bill's Minnesota team wins the specific game. As the losing team owner, Sue matches the $25 on the bet space 27, and Bill collects the $50 from the bet space 27. On all the players' score sheets, Minnesota receives a tally in its win column, and Florida receives a tally in its loss column.

Example 2

Sue rolls the dice first and rolls a ten (red die six, white die four) and moves onto a $10/$15 game space 14. Sue chooses one of the following four possible scenarios Florida or Atlanta (owned by Sue) vs. Minnesota (red six) or New York (white four). Sue decides to play her Atlanta team against Bill's New York team. Sue chooses to give Atlanta the advantage. She decides to wager $10 on the specific game and places this amount on the bet space 27. Sue overturns a four in the "advantage" cards 24, and Bill overturns a four in the "underdog" cards 26. Because the score is tied, the two players must roll the dice to determine the winner. Sue rolls a five on her die, and Bill rolls a one on his die. Sue's Atlanta team wins the specific game. As the losing owner, Bill matches the $10 on the bet space 27, and Sue receives the $20 from the bet space 27. All of the players place a tally in Atlanta's win column and a loss in New York's loss column on their score sheets.

Example 3

Tim rolls the dice first and rolls a twelve (red die six, white die six) and lands on a $5/$25 game space 14. Tim chooses one of these six possible game scenarios Toronto or Seattle or Colorado (owned by Tim) vs. Minnesota (red die six) or Atlanta (white die six). Tim decides to play his Toronto team against Sue's Atlanta team. Tim would like to give his Toronto team the advantage, but he can't afford to bet either of the two amounts on the game space 14. Therefore, Sue's Atlanta team receives the advantage. Sue decides to bet $5 on the specific game and places this amount on the bet space 27. Sue turns up a five in the "advantage" cards 24, while the top card in the "underdog" cards 26 is a seven. Tim's Toronto team wins in an upset. Sue must match the $5 on the bet space 27, and Tim collects the $10 from the bet space 27. All the players give Toronto a win and Atlanta a loss on their score sheets.

Example 4

Joan starts the specific game by rolling an eight (red die three, white die five) and landing on a $10/$20 game space 14. Joan can choose any one of six possible game scenarios Cincinnati or Los Angeles or Kansas City (owned by Joan) vs. Seattle (red three) or Florida (white five). Joan decides to play her Kansas City team against Tim's Seattle team. It turns out, though, that neither team owner can afford either of the betting amounts on the game space 14. In this situation, the game is canceled, and the turn moves on to the next player.

Example 5

Bill rolls the dice first and rolls a ten (red die six, white die four). He lands on a $10/$15 game space 14. Bill has only one choice for a specific game Minnesota (owned by Bill) vs. New York (white four). Bill decides to give Minnesota the advantage in the specific game. Because Bill owns both teams, the only amount that can be staked on the game is $0 even though that is not one of the amounts on the $10/$15 game space 14. Bill draws a ten for the Minnesota team from the "advantage" cards 24 and draws a six for his New York team in the "underdog" cards 26. Minnesota receives a tally in its win column, and New York receives a tally in its loss column on all the players' score sheets.

Example 6

Sue rolls first. She rolls a six (red die two, white die four) and moves onto the Atlanta Stadium space 16. Sue can choose either of these two possible game scenarios Atlanta (home) vs. Los Angeles (red two) or New York (white four). Sue has Atlanta play New York in a specific game. Because Atlanta is the home field team, it automatically receives the advantage. Sue happens to own Atlanta, so she bets an amount on the specific game anywhere from $0 to $25. Sue decides to be $20 on the specific game and places this amount on the bet space 27. Sue overturns a three in the "advantage" cards 24, and Bill overturns a zero in the "underdog" cards 26. Sue's Atlanta team beats Bill's New York team. Bill matches the $20 on the bet space 27, and Sue collects the $40 from the bet space 27. On all the players' score sheets, Atlanta earns a win and New York earns a loss.

Example 7

Tim rolls the dice first and rolls a six (red die one, white die five). He moves onto the Kansas City Stadium space 16. Tim can now choose one of the following game scenarios Kansas City (home) vs. Texas (red one) or Florida (white five). Tim has Joan's Kansas City team play Sue's Florida team. Kansas City automatically receives the advantage. Joan could normally choose to bet an amount anywhere from $) to $25. But in this case, Joan doesn't have any money, so she can only bet $0. Joan overturns a five in the "advantage" cards 24, and Sue overturns a nine in the "underdog" cards 26. Sue's Florida team beats Kansas City team in an upset. Florida receives a tally in its win column, and Kansas City receives a loss in its loss column on all the score sheets.

Example 8

Joan rolls the dice first and rolls an eleven (red die five, white die six). She lands on a move-ahead space 18. She moves ahead one space onto the Seattle Stadium space. Joan can choose either one of the following game scenarios Seattle (home) vs. Kansas City (red five) or Atlanta (white six). Joan has Seattle play Sue's Atlanta team. Tim owns the advantaged Seattle team, but he doesn't have any money, so he can't bet anything on the specific game. Tim overturns a seven in the "advantage" cards 24, and Sue overturns a one in the "underdog" cards 26. Seattle earns a tally in its win column and Atlanta receives a loss in its loss column on the players' score sheets.

After several rounds of play, the following information is given for each of Examples 9–12. Player Bill has the teams of Minnesota and New York and has $45. Player Sue has the teams of Florida and Atlanta and has $110. Player Tim has the teams of Toronto and Seattle, and has $85. Player Joan has the teams of Cincinnati, Los Angeles, and Kansas City, and has $20. The Pool has the teams of Chicago, Texas, and Colorado and has $1,440.

Example 9

Bill rolls a five on the two dice (red die three, white die two) and moves ahead five to the New York Stadium space. He can choose either of these game scenarios New York (home) vs. Seattle (red three) or Cincinnati (white two). Bill decides to play his New York team against Joan's Cincinnati team. He decides to bet $25 on the specific game and puts this amount on the bet space 27. Bill overturns a two in the "advantage" cards 24, and Joan overturns a four in the "underdog" cards 26. Bill's New York loses in an upset. All the players give New York a loss and Cincinnati a win on their score sheets. Bill cannot afford to match the $25 on the bet space 27 because he only has $20. Therefore, Bill must sell one of his teams, Minnesota or New York, to the pool. Bill decides to sell New York. The amount a team is sold for depends on its record. In this example, New York has one win and three losses. Bill plugs this information into the following formula:

$100+$10 (wins minus losses)=worth of team

NY (1–3) $100+$10 (1–3)=worth of team $100+$10 (–2)=worth of team $100–$20=$80.

At the moment, Bill's New York team is worth $80. Bill gives the pool New York's team card and receives $80. Bill matches the $25 on the bet space 27, and Joan collects the $50 from the bet space 27. Bill now has one team (Minnesota) and $75.

Example 10

It is Sue's turn to roll the dice. Before rolling though, Sue decides to try and buy Texas from the pool. Sue bids $70 for Texas. Tim is also interested in Texas so he bids $75. Neither Joan nor Bill wishes to bid, so it comes back to Sue. She bids $80 for Texas. Tim drops out of the bidding so Sue can buy Texas from the pool for $80. She gives the pool $80 and receives the Texas team card. Sue then continues on with her turn.

Using the same Example, let's say that rather than dropping out, Tim decides to bid $90 on Texas, hoping to drive up the price of Texas for Sue. Sue has a pretty good ideas of what Tim's trying to do, so she calls his bluff and drops out of the bidding. Tim must now pay $90 for Texas. He doesn't have enough money to cover his bid (he only has $85) so as a penalty, he must turn over ownership of one of his teams (Toronto or Seattle) to the pool. He decides to turn over Seattle's team card to the pool. Sue now continues on with her turn by rolling the dice. Texas stays in the possession of the pool.

Example 11

Tim rolls a two (red die one, white die one) and lands on a $5/$15 game space 14. He can choose any one of these four specific game scenarios Toronto or Seattle (owned by Tim) vs. Texas (red one) or Chicago (white one). Tim decides to give his Toronto team the advantage against the pool's Chicago team in a specific game. Tim bets $15 on the specific game and places this amount on the bet space 27. Tim overturns a five in the "advantage" cards 24 for Toronto and also overturns a five in the "underdog" cards 26 for Chicago. Tim must now roll dice for both teams to determine a winner. Tim tells the other players that the red die will represent Toronto, and the white die will represent Chicago. Tim rolls a three on the red die and a three on the white die. Because there is a tie, Tim rolls the dice again. He rolls a four on the red die and a one on the white die. Toronto wins in the tie breaker. Tim takes $15 from the pool and the $15 from the bet space 27 for himself. All the players give Toronto a win and Chicago a loss on their score sheets.

Example 12

Joan rolls an eight (red die six, white die two) and lands on the Chicago Stadium space. She can choose either of these two game scenarios Chicago (home) vs. Minnesota (red six) or Cincinnati (white two). Joan has the pool's Chicago team play Bill's Minnesota team. As the advantaged team owner, the pool always bets the highest amount on the space. On a stadium space, this amount is $25. Bill takes this amount from the pool and places it on the bet space 27. Bill then draws a nine from the "advantage" cards 24 and a three from the "underdog" cards 26. The pool's Chicago team wins. Bill matches the $25 on the bet space 27 and gives the total of $50 to the pool. On all the players' score sheets, Chicago receives a win, and Minnesota receives a loss.

The Examples set forth above are representative of most situations that arise during playing of the game provided by the sport wagering and outcome game apparatus of the invention. There are other situations, however, that may also arise, and some of these other situations are addressed below.

Perhaps once or twice during play of the game, the decks of the "advantage" cards 24 and the "underdog" cards 26 will run out of cards. When this happens. A player collects the cards from the two card-discard spaces 29 and 31, respectively. Each deck of cards is shuffled and place down on its respective locations on the game board 12.

It may happen during the game that two pool-owned teams play each other in a specific game. This can happen when a player has landed on a pool-owned team's home team space 16 and has that team play another pool-owned team that comes up on the dice. In such a case, no money is bet on the specific game because the pool owns both teams. The player who landed on the home team space 16 draws the top card from both the "advantage" cards 24 (home field) and the "underdog" cards 26 (dice-determined opponent). The winning team receives a tally in its win column, and the losing team receives a tally in its loss column on the score sheet as shown in FIG. 9. If the drawn numbers are the same, the player rolls one die for each team, making clear to the other players which die represents which team.

During play of the game, a player may not own any team at all. It is recalled, that when the game begins. Each player must buy at least one team to start the game. However, over the course of the game, due to bad luck or bad decisions. A player may find himself or herself with money but without any teams. In this situation, the player may want to bid on a team owned by the pool on his or her next turn. If the player bids on a team but is out bid by another owner, leaving the player still without a team, he or she continues with his or her turn by rolling the dice. If the player lands on a game space 14, the specific game is canceled because the player doesn't have a team to play the dice-determined opponent. If, however, the player lands on a home team space 16 or a move-ahead space 18, the player chooses an opponent determined by the dice for the home field team. As long as a player has at least $5 to his or her name, he or she can attempt to purchase a team and continue to roll the dice in turn.

If a player runs out of teams and all of his or her money, then the player is out of the game. If a player without a team bids the high bid for a pool-owned team but cannot afford to pay the bid amount due to lack of money, the player must forfeit all of his or her remaining money to the pool and is out of the game. The pool makes up the money for all unpaid debts. For example, suppose Bill has no money and owns only one team. The team has just lost a game and its record is now 1 to 9. Bill owes $25 to the bet space 27. He must sell his team to the pool for $20 because that is what it is worth and put this amount on the bet space 27. The pool puts up the remaining $5 on the bet space 27 for the winning owner to collect. Bill is now officially out of the game.

A situation may occur where all the players own teams but have no money, and the pool does not have any teams. In this situation, it is impossible for players to bet any money on games or for any money to become available in the future. The game can still be played, however. There just won't be any betting. One-half of the game spaces 14 on the game board 12 offer a bet of $0. Any time a player lands on one of these spaces. A game can be played. If a player lands on a game space 14 with a minimum bet of $5 or more, the specific game is canceled, and the turn moves on to the next player. This situation has the possibility of occurring at the beginning of almost every game if the players are not careful. In games has two, three, four, and six players. Each player can buy a certain number of teams at the beginning of the game that will leave him or her with no money to bet and will leave the pool without any teams. To avoid this occurrence and to play smartly in general. A player should always leave himself or herself some betting money at the start of the game.

After the regular season of specific games is over, the championship series is to begin. However, there may be a tie in the standings between one or more teams when the regular season is over. There is a predetermined order of rules to be applied for breaking a tie in the standings when the regular season is over. The tie breaking procedure should be followed to determine which team from each league advances to the championship series and which of the teams receives the advantage in the series. In the event of such a tie, first, the team with the highest (higher) winning fraction advances (is the favorite in the series). Second, the team with more wins is given the advantage. Third, the owner worth more in total assets (worth of all teams+money) has his or her contending team advance. Fourth, the owner with more money (not includes the worth of teams) advances his or her team. Fifth, the total wins achieved by all of an owner's teams are added together. The owner has more total wins advances his or her contending team. Sixth, the dice are rolled three times, and the owner that receives the best two of the three dice rolls advances his or her team to the championship or receives the advantage in the series.

Players will notice that the advantaged team earns the amount wagered when it wins a game, while the underdog team earns twice the amount wagered when it wins a specific game. The reason for this discrepancy is that the advantaged deck is mathematically favored 2 to 1 to win in a draw with the underdog deck. This is the rationale for the underdog to receive twice the amount wagered when it wins a specific game. The comparison of the "advantage" cards 24 and the "underdog" cards 26 is shown in FIG. 11. The chart in FIG. 11 indicates 729 draw combinations. The 27 numbers of the "advantage" cards are in the column along the left side of the chart in FIG. 11. The 27 numbers of the "underdog" cards are in the row at the top of the chart in FIG. 11. In summary of the chart in FIG. 11, there are 449 advantage wins. There are 206 underdog wins. There are 74 ties.

The components of the sport wagering and outcome game apparatus of the invention can be made from inexpensive and durable metal, paper, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved sport wagering and outcome game apparatus that is low in cost, relatively simple in design and operation, and which may advantageously be used to simulate the plurality of specific games that take place in a sport season. With the invention, a sport wagering and outcome game apparatus provides for the recording of win-loss records of individual teams during a season. With the invention, a sport wagering and outcome game apparatus is provided which includes wagering for specific games. With the invention, a sport wagering and outcome game apparatus provides a form of money which is the currency in which the wagering takes place. With the invention, a sport wagering and outcome game apparatus provides a schedule of specific games and the matching of opponents in specific games by unpredictable and random selection.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A sport wagering and outcome game apparatus, comprising:

a game board which includes a plurality of game spaces, wherein each game space represents a specific game, a group of tokens for movement on said game spaces of said game board, wherein each player adopts a specific token in said group of tokens, a first group of team cards corresponding to a first group of sport teams, a second group of team cards corresponding to a second group of sport teams, a first random number generator which generates numbers which correspond to individual teams of said first group of sport teams for selecting an individual first-group team to play in a specific game, a second random number generator which generates numbers which correspond to individual teams of said second group of sport teams for selecting an individual second-group team to play in a specific game, a first group of score-bearing cards which bears scores of player-predicted winners for specific games, a second group of score-bearing cards which bears scores of player-predicted losers for specific games, recording media for recording actual outcomes of specific games, that is, for recording winners and losers of specific games, money used for wagering by individual players with respect to actual outcomes of specific games, wherein a portion of said money is transferred from a player wagering for a win of an actual loser of a specific game to a player wagering for a win of an actual winner of a specific game.

2. The apparatus of claim 1 wherein said game spaces are arranged on said game board in a circuitous route.

3. The apparatus of claim 1 wherein said game board further includes home team spaces.

4. The apparatus of claim 3 wherein said home team spaces are designated "stadium" spaces.

5. The apparatus of claim 1 wherein said game board further includes move-ahead spaces.

6. The apparatus of claim 1 wherein said first group of sport teams corresponds to a first league.

7. The apparatus of claim 1 wherein said second group of sport teams corresponds to a second league.

8. The apparatus of claim 1 wherein said first group of team cards and said second group of team cards are merged and combined into a combined group of team cards.

9. The apparatus of claim 1 wherein said first group of score-bearing cards are designated "advantage" cards.

10. The apparatus of claim 1 wherein said second group of score-bearing cards are designated "underdog" cards.

11. The apparatus of claim 1 wherein:

said first group of sport teams correspond to a first league of baseball teams, said second group of sport teams correspond to a second league of baseball teams, and said specific games correspond to specific baseball games.

* * * * *